US009607785B1

(12) United States Patent
Morales et al.

(10) Patent No.: US 9,607,785 B1
(45) Date of Patent: Mar. 28, 2017

(54) TEMPORARY RESTRICTION OF ACCESS TO CIRCUIT BREAKERS

(71) Applicant: Amazon Technologies, Inc., Seattle, WA (US)

(72) Inventors: Osvaldo P. Morales, Seattle, WA (US); Michael P. Czamara, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/866,141

(22) Filed: Sep. 25, 2015

(51) Int. Cl.

| | |
|---|---|
| ***H01H 9/28*** | (2006.01) |
| ***H01H 9/02*** | (2006.01) |
| ***H01H 13/68*** | (2006.01) |
| ***H01H 21/04*** | (2006.01) |

(52) U.S. Cl.
CPC ..... *H01H 9/282* (2013.01); *H01H 9/02* (2013.01); *H01H 13/68* (2013.01); *H01H 21/04* (2013.01); *H01H 2239/032* (2013.01)

(58) Field of Classification Search
CPC ..... H01H 9/282; H01H 9/02; H01H 13/68; H01H 21/04; H01H 2239/032; H01H 9/283; H01H 9/287; H01H 9/286; H01H 9/0264; H01H 3/20
USPC ..... 200/43.11, 43.01, 43.14, 43.16
See application file for complete search history.

(56) References Cited

U.S. PATENT DOCUMENTS

| | | | | |
|---|---|---|---|---|
| 6,791,040 | B1 * | 9/2004 | Puhalla | H01H 9/283 200/43.14 |
| 7,262,376 | B2 * | 8/2007 | Brojanac | H01H 9/283 200/43.14 |
| 8,748,759 | B2 * | 6/2014 | Howard | H01H 9/282 200/43.14 |
| 9,373,459 | B1 * | 6/2016 | Mininberg | E05B 13/002 |

OTHER PUBLICATIONS

Kirk Key Interlock Company, LLC. Company page. [online] Kirk Key Interlock Company, 2014. [retrieved on Aug. 18, 2018]. Retrieved from the Internet: http://www.kirkkey.com/, 1 page.
Castell, company page [online] Castell 1997-2012. [retrieved on Aug. 18, 2015]. Retrieved from the Internet http://www.castell.com/us/, 1page.

* cited by examiner

*Primary Examiner* — Edwin A. Leon
(74) *Attorney, Agent, or Firm* — Kilpatrick Townsend & Stockton LLP

(57) ABSTRACT

A circuit breaker can actuate to a closed condition and to an open condition. An assembly for the circuit breaker can include an obstacle that can be positioned to obstruct one form of actuation while permitting another form of actuation. The obstacle can be moved from the obstructing position to allow multiple forms of actuation. The obstacle may permit manual actuation of the circuit to an open state in any position.

20 Claims, 5 Drawing Sheets

TEMPORARY RESTRICTION OF ACCESS TO CIRCUIT BREAKERS

BACKGROUND

A datacenter is a facility used to house a collection of computer servers and associated components, typically network hardware. The collection of computer servers is often called a "server cluster" or "server farm," and is designed to accomplish server needs far beyond the capability of a single machine. The networking hardware typically includes network switches and/or routers which enable communication between the different parts of the server farm and the users of the server farm. Datacenters are commonly used for cluster computing, web services, remote data storage, web hosting, and other web services. Datacenters are increasingly being used by enterprises instead of, or in addition to, mainframe computers. As the demand for datacenters continues to increase, a need exists to limit the cost of operating a datacenter and/or to maintain availability of datacenter computing resources.

In various scenarios, datacenter components may undergo transfer events, in which power is switched from one power source to another power source. Such switching may occur, for example, between an on-site emergency generator and a utility grid, such as in response to a loss of power in the grid, or following restoration of grid power after an outage. Switching may also be performed to balance loads among different areas of a datacenter, such as during the introduction of new components to expand capacity or to isolate components, such as for maintenance. Specific sequences of actuating circuit breakers are often utilized to facilitate transfer events. Such sequences can be prone to human error, such as if a technician misunderstands the sequence, loses his or her place in the sequence, and/or otherwise unintentionally actuates circuit breakers out of order. Such errors can result in unacceptable losses in availability of datacenter computing resources and/or cause costly damage to datacenter components.

BRIEF DESCRIPTION OF THE DRAWINGS

Various embodiments in accordance with the present disclosure will be described with reference to the drawings, in which.

DETAILED DESCRIPTION

Figure 1:
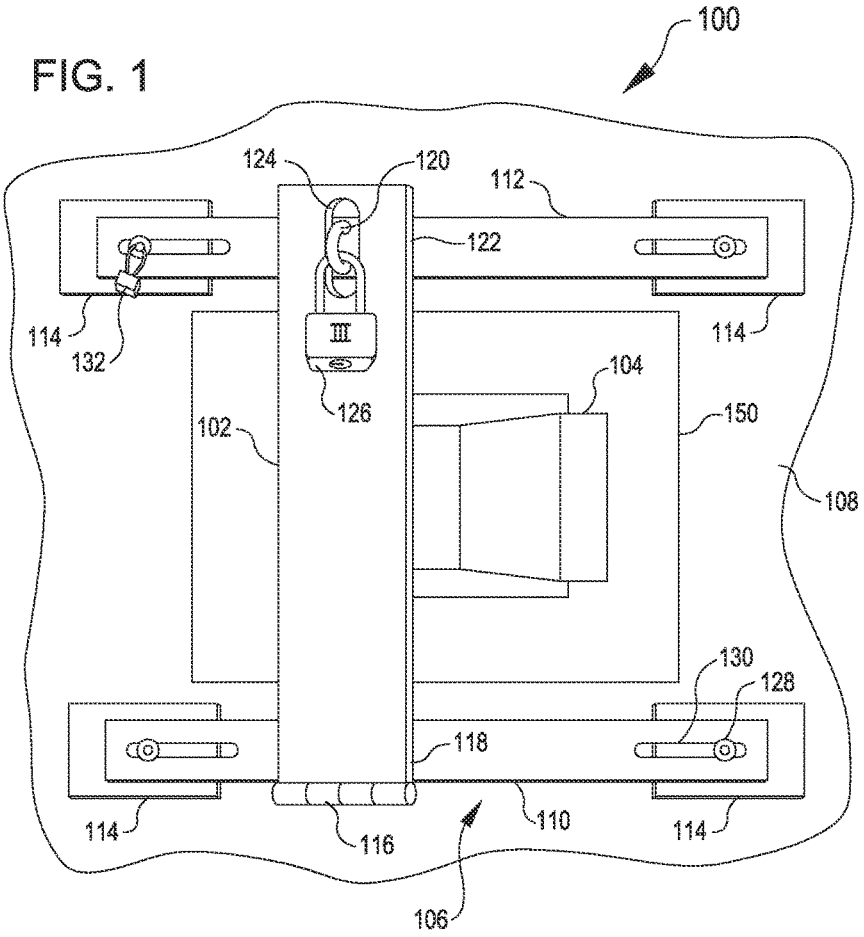
FIG. 1 illustrates an example of a device for restricting access to a circuit breaker according to various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various embodiments herein are directed to a device that can be installed to restrict access to circuit breakers or other switching controls. The device can be installed as a cover over a circuit breaker, such as by attaching to a housing that frames the circuit breaker. When installed, an arm of the device is positioned so as to obstruct access for a human operator to a button or lever that controls switching of the circuit breaker. A lock secures the arm in the obstructing position and prevents full access to the circuit breaker until the lock is removed or unlocked. This may reduce a chance that the circuit breaker will be actuated by an unauthorized operator or out of a designated order, such as during a transfer event. The arm in the obstructing position also allows the circuit breaker to be actuated to open and disconnect the power supply through the circuit breaker in an emergency situation. This may allow the devices to be compliant with electrical codes that may require that circuit breakers be capable of shutting off at any given point in case of an emergency. Such emergency access can be provided, for example, through the position of the arm in the obstructing position and/or the features of the arm (such as a breakable glass panel covering a passage through the arm).

As an illustrative example, an arm can be positioned in the path of a circuit breaker lever such that the lever is permitted to move a sufficient distance to break the circuit (e.g., automatically or under a force supplied by human operator in an emergency), yet prevented by the arm from reaching a reset point from which the lever can be moved back to a closed position of the circuit. The arm can be secured in this position by a lock, thus deterring a human operator from actuating the circuit breaker out of order during a sequence of operations to facilitate a transfer event, yet allowing the circuit breaker to be actuated to shut off in an emergency.

As may accordingly be appreciated, devices disclosed herein may provide a physical component useful for directing human operators through a sequence of switching operations for a transfer event. Multiple of the devices can be used together to assist an operator in progressing through a sequence. For example, the devices can use indicia or a series of locks that open in a predetermined sequence to assist the operator in progressing through a sequence of switching operations for a transfer event. The devices can be additionally or alternatively be useful for preventing access to the circuit breakers by individuals without proper authorization. For example, an arm may be secured over a breaker by a lock that requires a particular key or other unlocking mechanism that can be maintained solely by authorized personnel.

Referring now to the drawings, FIG. 1 illustrates an example of a cover or device 100 for restricting access to a circuit breaker 150. Generally, a circuit breaker is an automatically operated electrical switch designed to protect an electrical circuit from damage caused by overload or short circuit. Typically, circuit breakers include components that detect a fault condition and interrupt current flow. Circuit breakers are often used to protect datacenter components from excessive amounts of power and/or to control power distribution among datacenter components. Circuit breakers also typically include mechanisms that can be manually actuated by a human operator to switch the associated circuit to a closed condition (e.g., permitting current flow), to an open position (e.g., preventing current flow), and/or to a reset position (e.g., for transitioning between the open and closed conditions). For example, the circuit breaker 150 in FIG. 1 includes a lever 104 that can be pulled from the depicted position an initial amount toward the left of FIG. 1 to move from a closed position to an open position, pulled further toward the left of FIG. 1 to move from an open position to a reset position, and pulled toward the right of FIG. 1 to move from the reset position (e.g., past the open position) to return to the closed position.

The device 100 can include an obstacle. The obstacle can be any structure that can be positioned to block actuation of a circuit breaker or some portion thereof. For example, the obstacle may block actuation to open, closed, and/or reset states or conditions of the circuit breaker. In the embodiment shown in FIG. 1, the obstacle is an arm 102 that is positioned in the path of the lever 104 of the circuit breaker 150. Such positioning can prevent an operator from actuating the lever 104 to the reset position, such as from the closed position or from the open position.

The arm 102 is secured via a base 106 to a housing 108 that frames the circuit breaker 150. The housing 108 can correspond to the structure in which the circuit breaker 150 is mounted, such as in a wall, in an electrical panel, or in a server rack in a datacenter. In some embodiments, the housing 108 forms a part of the circuit breaker 150. The base 106 can include any structure that facilitates mounting to the housing 108. In the depicted embodiment, the base 106 includes a first bar 110 and a second bar 112. The first bar 110 and the second bar 112 are each coupled with the housing 108 through mounting segments 114. In various embodiments, the mounting segments 114 include magnets that attach the base 106 to a metal surface of the housing 108. Additionally or alternatively, the mounting segments may use other mounting mechanisms, including but not limited to adhesives, bolts, rivets, or other fasteners. However, using magnets in lieu of such fasteners may cause less damage to the housing 108 and/or facilitate ease of removal (e.g., so that the device 100 can be utilized elsewhere if access restriction is no longer desired at the circuit breaker 150 where the device 100 is installed). In some embodiments, magnets may be selected so that an adhesion force of the magnets to the housing 108 warrants use of a pry bar or other tool to remove the device 100.

The arm 102 can couple with the base 106 in a way that facilitates various configurations of the arm 102. For example, the first bar 110 depicted in FIG. 1 includes a hinge 116 that attaches a first end 118 of the arm 102 to the first bar 110 and allows the arm 102 to pivot. This may allow the arm 102 to be moved into an obstructing position that prevents the lever 104 of the circuit breaker 150 from traveling a full range of actuation, e.g., from travelling to a reset position.

Any suitable locking features can be used to secure the arm 102 in position. Locking features can include any structure that facilitates secure attachment that can be released upon operation of an appropriate key or other unlocking feature. For example, in FIG. 1, the second bar 112 includes a hasp 120. A second end 122 of the arm 102 includes an opening 124 sized to be received over the hasp 120. The hasp 120 extends through the opening 124 a sufficient distance for a lock 126 to be secured through the hasp 120. The lock 126 can retain the arm 102 against the second bar 112. This can keep the arm 102 in a position that restricts access to the circuit breaker 150 for manual actuation to the reset position, yet allows the circuit breaker 150 to trip from an open position to a closed position, such as automatically or under a force exerted by a person in an emergency. Preventing the lever 104 from reaching the reset position may also have the effect of preventing the circuit breaker 150 from being actuated back to a closed position. For example, the position of the arm 102 in FIG. 1 may prevent the lever 104 from being moved to a reset position until a key for the lock 126 reaches the circuit breaker 150.

Additionally, locking mechanisms other than the hasps depicted and described herein can be utilized for securing or locking an arm or obstacle in a blocking or obstructing position. Non-limiting examples of other suitable locking mechanisms include a releasable bracket extending over the arm, a keyway that extends through the arm and secures the arm to the base when a key is turned in the keyway, and locks that may lock or unlock using electromagnets.

Figure 2:
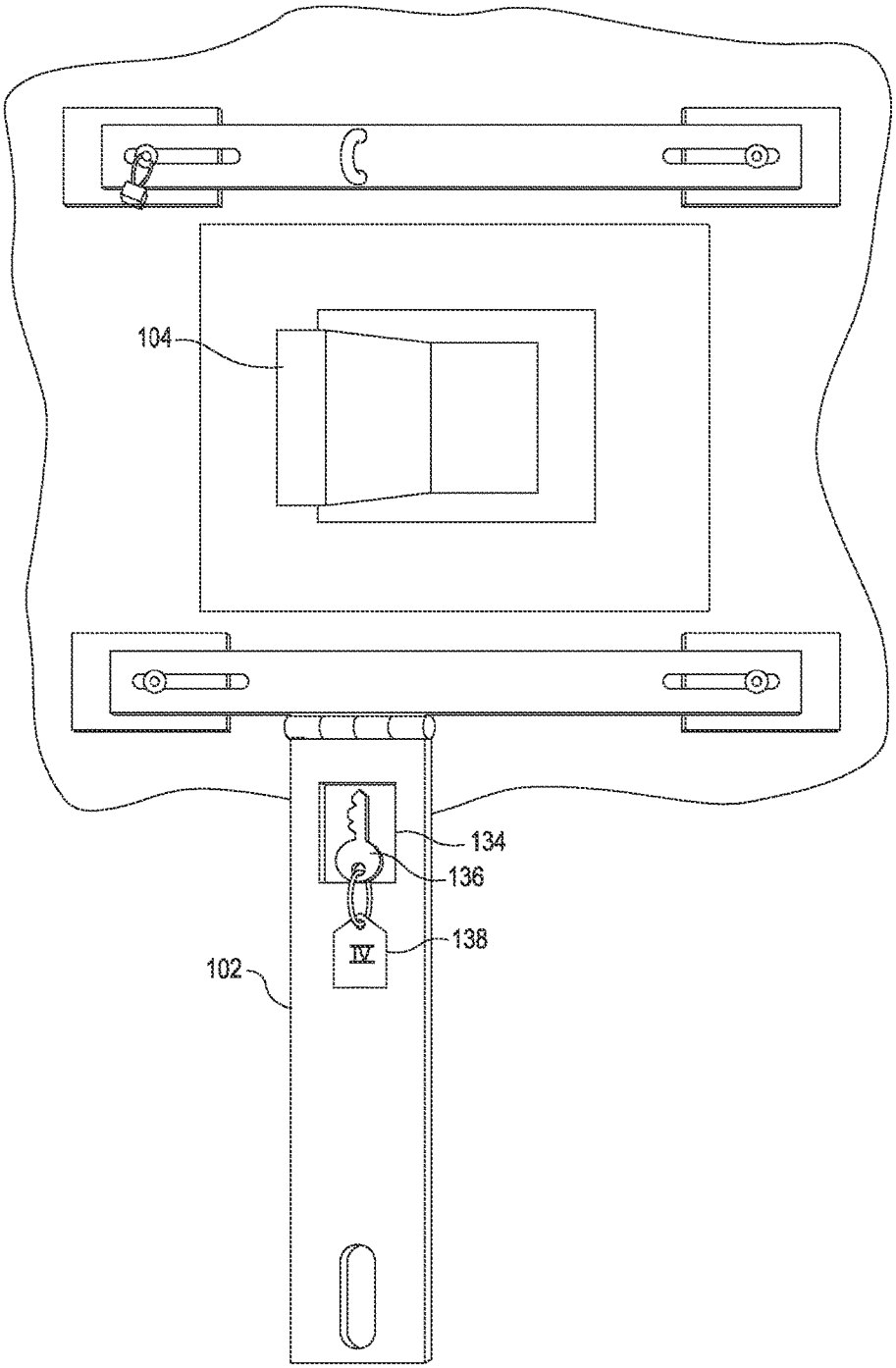
FIG. 2 illustrates the device of FIG. 1 in an accessible configuration according to various embodiments.

FIG. 2 illustrates the device 100 in an accessible position according to certain aspects. In operation, a human operator may disconnect the lock 126 (FIG. 1) and move the arm 102 out of the path of the lever 104 (e.g., from the position of the arm 102 in FIG. 1 to the position in FIG. 2). With the arm 102 out of the way, the operator may actuate the lever 104 (e.g., from the position in FIG. 1 to the position in FIG. 2). Such actuation may prepare the lever 104 of the circuit breaker to be moved back to a closed position of FIG. 1. Moving the arm 102 to the position in FIG. 2 can provide a visual indicator for a technician that indicates that the operation prevented by the arm 102 has been performed, allowing the operator to more easily maintain a place within the sequence of switches for a transfer event.

The arm 102 shown in FIG. 2 includes a recess 134 for retaining a key 136. The key 136 may be used for a subsequent lock to be opened in the transfer process. For example, the lock in FIG. 1 includes an indicia that indicates that the lock is the third in the sequence, and the key retained within the arm 102 can include an indicia, e.g., on a tag 138, that indicates that the key 136 can be used for a fourth lock in the transfer sequence. The key 136 for the subsequent lock may be made available upon opening the lock 126 that secures the arm 102 in the obstructing position so as to restrict access to the subsequent lock until the prior lock 126 has been unlocked.

The bars 110 and 112 shown in FIG. 1-2 are slidingly coupled to the mounting segments 114 via pins 128 and slots 130. Such an arrangement can allow the bars 110, 112 to be adjusted in position after the mounting segments 114 are attached to the housing 108. Such position adjustment may allow the arm 102 to be moved to a desirable position within the path of the lever 104. FIGS. 1-2 also illustrate identification tag 132, such as may be included upon installation of the device 100, e.g., to indicate that the device 100 was installed at a particular time, by a particular person, etc., for example, to provide documentation and/or an indication that the device was adequately installed.

Figure 3:
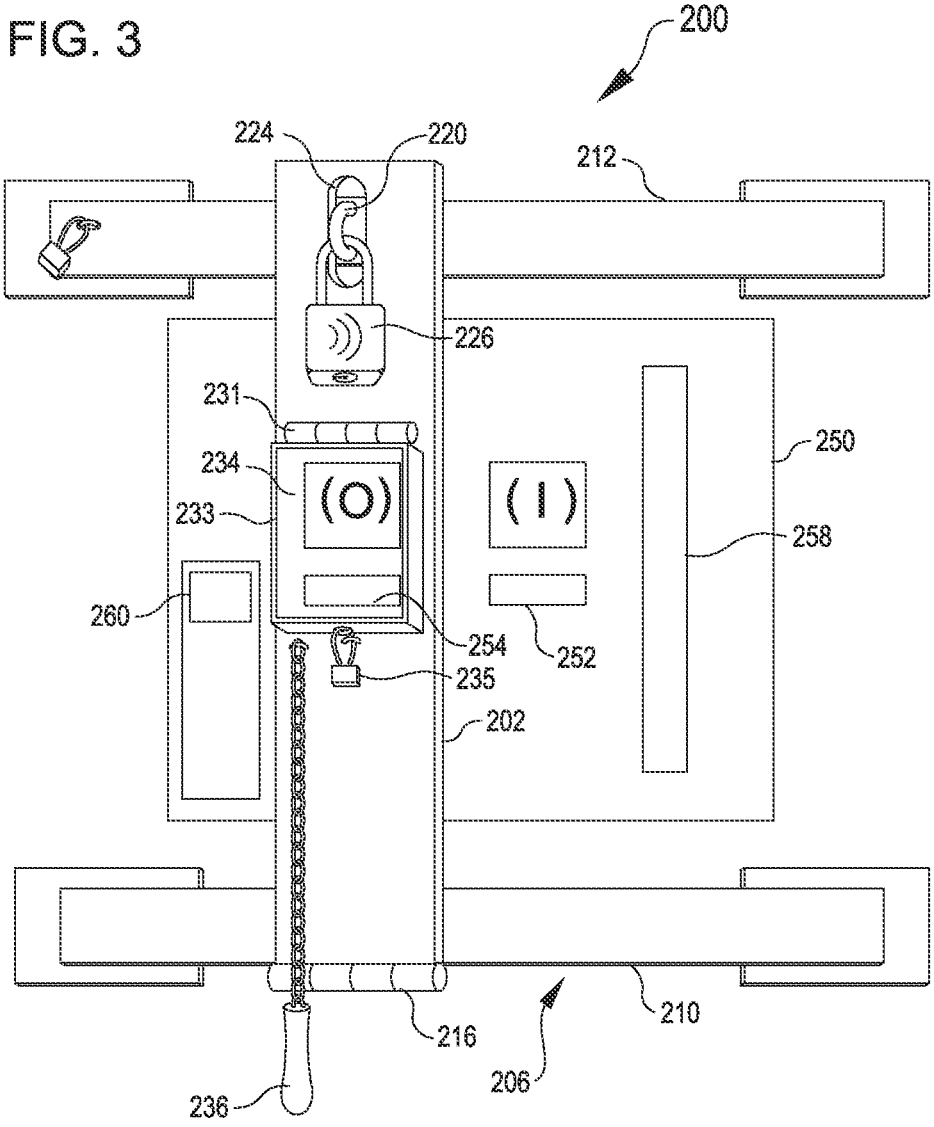
FIG. 3 illustrates another example of a device for restricting access to a circuit breaker according to various embodiments.

FIG. 3 illustrates another example of a device 200 for restricting access to a circuit breaker 250. The circuit breaker 250 illustrated in FIG. 3 shows a different circuit breaker from the circuit breaker of FIGS. 1-2. However, it will be appreciated that devices disclosed herein can be adapted to operate with any type of circuit breaker. The circuit breaker 250 illustrated in FIG. 3 includes a closing button 252 for closing the circuit breaker 250 (e.g., providing power therethrough) and an opening button 254 for interrupting the flow through the circuit breaker 250. The device 200 includes a base 206 with bars 210 and 212 that support an arm 202, similar to features of similar names described with respect to FIG. 1. The arm 202 in FIG. 3 pivots relative to the base 206 via a hinge 216 to cover the opening button 254. Similar to the device 100 of FIG. 1, a hasp 220 extends through an opening 224 in the arm 102 so that the arm 202 is secured over the button 254. However, other locking mechanisms can be used in place of the hasp 220.

The arm 202 can include a structure that is configured for breaking by a human operator to allow the operator to gain access to the button 254 in case of an emergency. As one example illustrated in FIG. 3, this structure may correspond to a layer 234 of material (e.g., glass) that is configured to be broken by a tool 236 by a human operator in order to gain access to the button 254 via a passage through the arm 202 in case of an emergency. As another example illustrated in FIG. 3, the structure may correspond to a tag 235, cord, or other breakable piece that maintains a hatch 233 in place over the passage to the button 254. Upon breaking the structure, the hatch 233 can be opened (e.g., pivoting at hinge 231) to provide access through the passage to the button 254. In various embodiments, a device 200 lacking an unbroken structure (e.g., having a broken or missing layer 234 or a broken or missing tag 235) may provide a visual indicator that a switching operation has been performed apart from a planned sequence and prompt the operator to abort the sequence or to take other appropriate actions.

Additionally, the arm 202 illustrated in FIG. 3 is sized and arranged so as to not interfere with other features of the circuit breaker 250, such as a charge arm 258 (e.g., for preparing the circuit breaker 250 for actuation by the buttons 252, 254) or a meter 260 (e.g., such as for showing amps, voltage or other characteristics of power provided through the circuit breaker 250). Additionally, it may be appreciated that the arm 202 may be positioned instead over the closing button 252 in some situations or embodiments. The device can utilize any sort of lock 226. For example, in contrast to the lock 126 shown in FIG. 1, the lock 226 shown in FIG. 3 may be configured to open in response to an electronic signal, such as from recognition of a badge, a thumb print, or some other indication of authorization.

Figure 4:
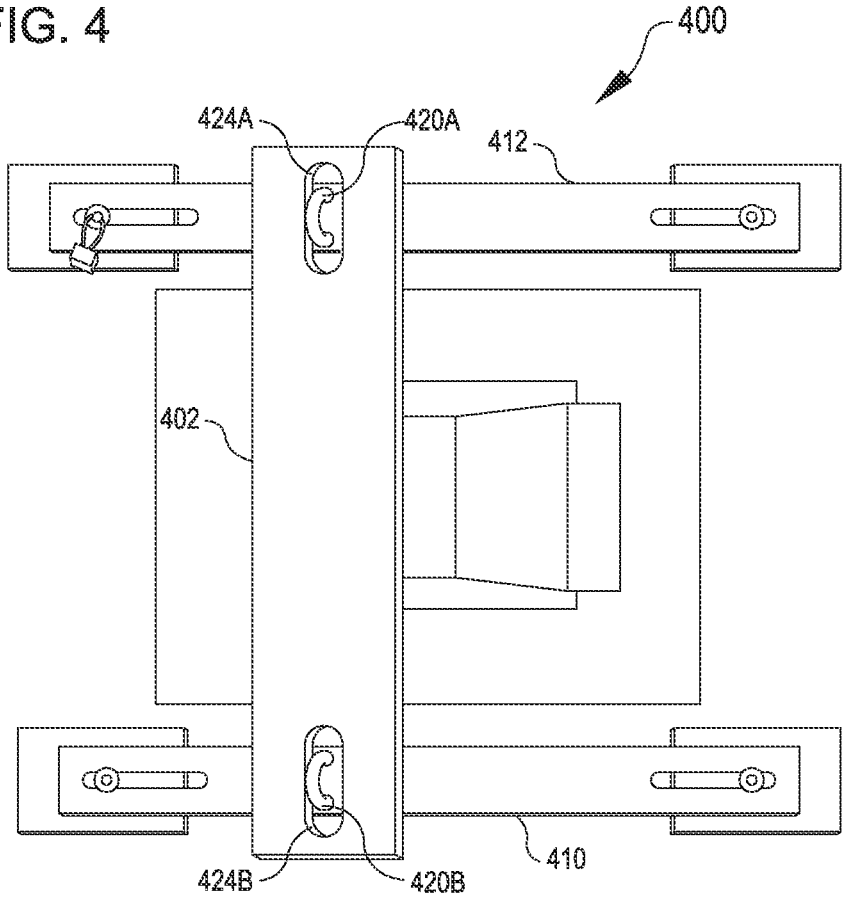
FIG. 4 illustrates a further example of a device for restricting access to a circuit breaker according to various embodiments.

In some embodiments, the arm can be attached without a hinge. For example, FIG. 4 illustrates a device 400 in which an arm 402 includes openings 424*a*, 424*b* at either end of the arm 402. The openings 424*a*, 424*b* can engage hasps 420*a*, 420*b* or other locking mechanisms so that the arm 402 can be secured to the bars 412 and 410. Providing multiple hasps 420*a*, 420*b* or multiple other locking mechanisms can allow multiple keys to be used, which can provide multiple sets of verification, such as to improve accuracy within the transfer event or reduce a likelihood of a switching operation occurring out of order. Additionally, although the openings 424*a*, 424*b* are shown on opposite sides of the arm 402, the arm may instead include multiple openings 424*a*, 424*b* or other locking mechanisms at the same end.

Figure 5:
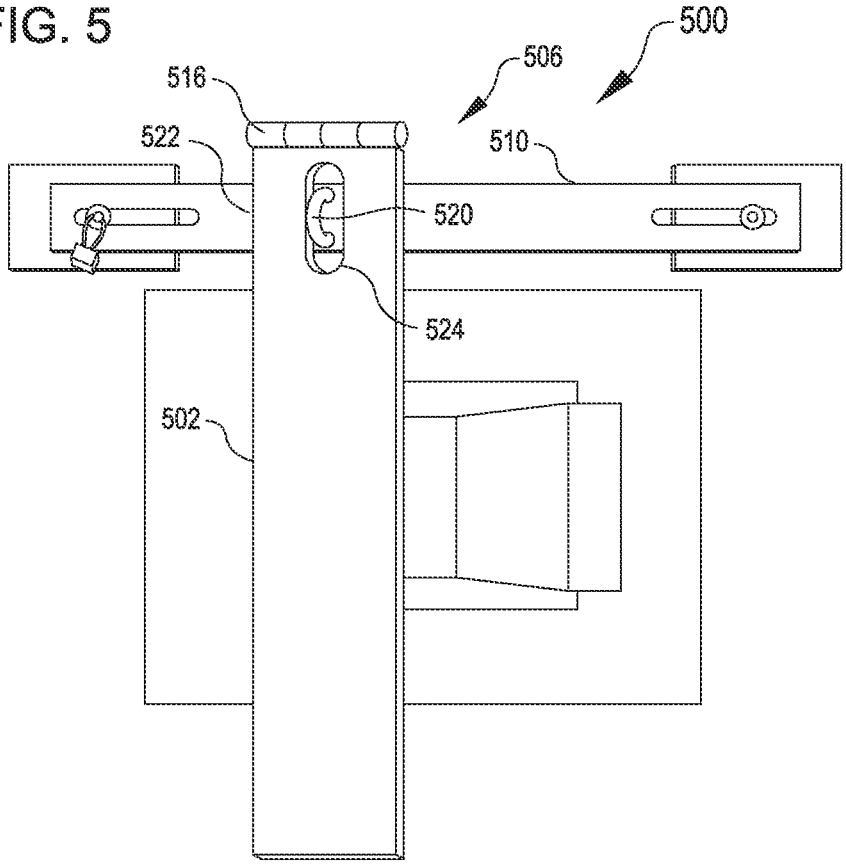
FIG. 5 illustrates yet another example of a device for restricting access to a circuit breaker according to various embodiments.

In some embodiments, other types of base can be used. For example, in contrast to the arrangement of FIG. 1 that includes a first bar 110 and a second bar 112, FIG. 5 illustrates a device 500 having a base 506 with a single bar 510. The base 506 shown in FIG. 5 includes a hinge 516 for coupling the bar 510 to an arm 502. The bar 510 also includes a hasp 520 that extends through an opening 524 at the same end 522 of the arm 502 as the hinge 516. This arrangement can reduce the number of parts for the device 500 while still providing similar functionality to the device 100 of FIG. 1.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A circuit breaker assembly comprising:

a circuit breaker having a lever movable among a closed position, an open position, and a reset position, the lever configured for movement from the open position to the closed position via the reset position and for movement from the closed position directly to the open position;

a housing that frames the circuit breaker;

a cover comprising:

a base installed on the housing, the base comprising (a) a first bar attached to the housing and comprising a hinge; and (b) a second bar attached to the housing and comprising a first locking feature; and an arm comprising a first end and a second end, the first end pivotally coupled with the first bar via the hinge such that the arm is pivotable between (a) an obstructing position in which the arm obstructs movement of the lever of the circuit breaker to the reset position and permits movement of the lever of the circuit breaker from the closed position to the open position, and (b) an accessible position in which the arm permits movement of the lever of the circuit breaker to the reset position; and a second locking feature that is (a) engagable with the first locking feature to secure the second end of the arm with the second bar so that the arm is locked in the obstructing position, and (b) disengagable from the first locking feature to release the second end of the arm from the second bar so as to permit movement of the arm to the accessible position.

2. The circuit breaker assembly of claim 1, wherein the first bar comprises a mounting segment configured for attaching to the housing, the mounting segment comprising magnets.

3. The circuit breaker assembly of claim 1, further comprising a mounting segment configured for attaching to the housing, wherein the first bar is slidingly coupled with the mounting segment so that a position of the arm is adjustable relative to the breaker by sliding the first bar relative to the mounting segment when the mounting segment is attached to the housing.

4. The circuit breaker assembly of claim 1, wherein the first bar comprises a mounting segment configured for releasably attaching to the housing.

5. The circuit breaker assembly of claim 1, wherein the first locking feature comprises a hasp and the second locking feature comprises a lock routed through the hasp.

6. The circuit breaker assembly of claim 1, wherein the arm comprises a recess for holding a key.

7. An apparatus comprising:

a cover comprising:

a base configured to be installed on a circuit breaker housing, wherein the housing frames a circuit breaker, the circuit breaker having a first button actuatable to switch the circuit breaker to an open condition and a second button actuatable to switch the circuit breaker to a closed condition; and an arm reconfigurable relative to the base between (a) an obstructing position in which the arm is coupled with the base so that the arm obstructs access to one of the first button or the second button and permits access to the other of the first button or the second button, and (b) an accessible position in which the arm permits access to both the first button and the second button; and a locking feature that is (a) engagable to secure the arm with the base so that the arm is locked in the obstructing position, and (b) disengagable to release the arm from the base so as to permit movement of the arm to the accessible position;

wherein the cover further comprises a structure configured for breaking to provide access, when the locking feature is engaged, via a passage through the arm to whichever of the first button or the second button has access obstructed by the arm in the obstructing position.

8. The apparatus of claim 7 wherein the locking feature comprises a lock received in a hasp attached to the base.

9. The apparatus of claim 7, wherein the base comprises a first bar and a second bar, wherein the arm extends from the first bar to the second bar in the obstructing position.

10. The apparatus of claim 9, wherein the arm is attached to the base in the obstructing position via a first hasp on the first bar and a second hasp on the second bar.

11. The apparatus of claim 7, further comprising a hinge pivotally coupling the arm with the base.

12. The apparatus of claim 7, wherein the structure comprises a layer of material covering the passage, the circuit breaker assembly further comprising a tool coupled with the cover and configured for breaking the layer.

13. The apparatus of claim 7, wherein the arm is configured to expose a display or instrument on the circuit breaker when the apparatus is installed on the circuit breaker housing.

14. An apparatus comprising:

an obstacle for affixing near a circuit breaker, the circuit breaker actuatable to a closed condition and actuatable to an open condition, where the obstacle is configurable between an obstructing position and an accessible position, the obstacle in the obstructing position covering at least a part of the circuit breaker so as to obstruct one of manual actuation to the closed condition or manual actuation to the open condition and permit the other of manual actuation to the closed condition or manual actuation to the open condition, the obstacle in the accessible position positioned relative to the circuit breaker so as to permit both manual actuation to the closed condition and manual actuation to the open condition; and wherein the obstacle is configured to permit the manual actuation of the circuit breaker to the open condition when the obstacle is in the obstructing position.

15. The apparatus of claim 14, wherein the obstacle being configured to permit the manual actuation of the circuit breaker to the open condition when the obstacle is in the obstructing position comprises the obstacle including a passage through the obstacle, the passage blocked by a structure configured to be broken to provide access through the passage.

16. The apparatus of claim 14, wherein the obstacle being configured to permit the manual actuation of the circuit breaker to the open condition when the obstacle is in the obstructing position comprises the obstacle in the obstructing position being positioned so as to obstruct manual actuation to the closed condition and permit manual actuation to the open condition.

17. The apparatus of claim 14, wherein the circuit breaker comprises a first button actuatable to switch the circuit breaker to the open condition and a second button actuatable to switch the circuit breaker to the closed condition, wherein the obstacle in the obstructing position covers one of the first button or the second button.

18. The apparatus of claim 14, wherein the circuit breaker comprises a lever actuatable among an open position to switch the circuit breaker to the open condition and a closed position to switch the circuit breaker to the closed condition, wherein the obstacle in the obstructing position covers a part of a path of the lever.

19. The apparatus of claim 14, wherein the circuit breaker comprises a lever movable among a closed position corresponding to the closed condition of the circuit breaker, an open position corresponding to the open condition of the circuit breaker, and a reset position, the lever configured for movement from the open position to the closed position via the reset position and for movement from the closed position directly to the open position, wherein the obstacle in the obstructing position covers a part of a path of the lever from the reset position to the closed position.

20. The apparatus of claim 14, further comprising a locking feature that is (a) engagable to lock the obstacle into the obstructing position, and (b) disengagable to release the obstacle so as to permit movement to the accessible position.

* * * * *